US005565258A

United States Patent [19]

McConnell et al.

[11] Patent Number: 5,565,258

[45] Date of Patent: Oct. 15, 1996

[54] FOLDED ABSORBENT PAPER PRODUCT AND METHOD

[75] Inventors: Wesley J. McConnell, Glen Mills, Pa.; John A. Bound, Essex, United Kingdom

[73] Assignee: Kimberly-Clark Corporation, Neenah, Wis.

[21] Appl. No.: 397,398

[22] Filed: Mar. 2, 1995

[51] Int. Cl.[6] ..... B32B 3/04

[52] U.S. Cl. ..... 428/122; 206/494; 221/47; 221/48; 221/49; 221/52; 428/121; 428/124; 428/126; 428/192

[58] Field of Search ..... 428/122, 124, 428/126, 192, 121; 206/494; 221/47, 48, 49, 52; 604/385.1

[56] References Cited

U.S. PATENT DOCUMENTS

| | | | |
|---|---|---|---|
| 1,122,108 | 12/1914 | Hamilton | 221/47 |
| 1,177,466 | 3/1916 | Winter | 206/494 |
| 1,256,334 | 2/1918 | Lazar | 221/48 |
| 1,996,307 | 4/1935 | Shapiro | 206/57 |
| 3,047,141 | 7/1962 | Burns | 206/57 |
| 3,207,360 | 9/1965 | Scott | 221/48 |
| 4,143,762 | 3/1979 | Spiegelberg | 206/210 |
| 4,181,225 | 1/1980 | Spiegelberg | 206/494 |
| 5,023,126 | 6/1991 | Stevens et al. | 428/126 |
| 5,118,554 | 6/1992 | Chan et al. | 428/126 |

*Primary Examiner*—Nasser Ahmad
*Attorney, Agent, or Firm*—Karl V. Sidor

[57] ABSTRACT

An improved folded absorbent paper product includes a first, central panel; a second panel, unitary with the first panel and folded over a first side of said first panel; a third panel, unitary with the first panel, and folded over a second side of the first panel; a fourth panel, unitary with the second panel, and folded so as to be positioned between the first and second panels; and a fifth panel that is unitary with the third panel and folded so as to be positioned between said first and third panels. Advantages of the improved product include an optimization of weight to space considerations, the fact that exposed edges are kept out of view, an ability to work in a gravity feed dispenser in any of four possible orientations, and an assurance of double ply strength at intended gripping locations. A method of dispensing and of use is also disclosed.

9 Claims, 3 Drawing Sheets

FOLDED ABSORBENT PAPER PRODUCT AND METHOD

BACKGROUND OF THE INVENTION

1. Field of the Invention

This invention pertains, in general, to folded web products and processes for dispensing such products. More specifically, this invention relates to an improved dispensable folded absorbent paper product, such as a paper towel for a public washroom, that provides improved absorbency to weight and to volume with respect to conventional C-fold paper products, is aesthetically pleasing and is virtually impossible to misload in a gravity feed dispenser.

2. Description of the Prior Art

Folded absorbent paper products, such as the folded paper towels that are commonly provided in public washroom dispensers, have been and are in wide use throughout the world.

The most common type of paper towel fold, known as the "C-fold," is depicted in diagrammatical cross-section in FIG. 1. A C-fold towel 10 typifically has a closed end 12 that is defined by a main panel 14 of absorbent paper material and an open end 16 that is defined by secondary and tertiary absorbent paper panels 18, 20, respectively. Secondary and tertiary panels 20 are unitary with main panel 14, and are, respectively, connected to main panel 14 at fold lines that are at opposite ends of main panel 14, as maybe seen in FIG. 1. Open end 16 includes an open gap 22 that is between the secondary and tertiary panels 18, 20. A C-fold is most commonly made up of a two ply material, such as the first ply 24 and the second ply 26 shown in FIG. 1.

One common problem with C-fold type paper towels may be seen in reference to FIGS. 2A and 2B. C-fold towels are designed to be stacked in a gravity feed dispenser 28 of the type that has a lower opening 30 so that the open end 16 faces downwardly, as is shown in FIG. 2A. In this position, a user can grab either the secondary or tertiary panel 18, 20 to pull the towel 10 out of the dispenser 28. However, when stacked improperly, as shown in FIG. 2B, with the closed end 12 oriented downwardly, dispensing is awkward, and often results in wastage. Not uncommonly, maintenance personnel will stack C-fold towels improperly, as shown in FIG. 2B, rather than as shown in FIG. 2A.

Many gravity feed dispensers have offset openings at the bottom. Most C-fold towels are symmetrical in the sense that the secondary panel 18 is of the same length as the tertiary panel 20. As a result, conventional C-fold towels cannot be loaded in a manner that is optimum for a dispenser having an offset throat.

Moreover, C-fold type towels utilize space inefficiently in the sense that the towel is twice as thick beneath the secondary and vertical panels as in the area beneath the open gap 22. This adversely affects the density with which the towels can be stored in a dispenser. In addition, the uneven density distribution across the width of the C-fold towel 10 can result in a "seagulling" effect, in which a stack of towels will bow at the center.

It is clear that a long and unfilled need has existed in this area of technology for an improved absorbent paper product, such as a paper towel for a public wash room, that provides improved absorbency to weight and to volume with respect to conventional paper products, is aesthetically pleasing, and is virtually impossible to mis-load in a gravity feed type dispenser.

SUMMARY OF THE INVENTION

Accordingly, it is an object of the invention to provide an improved folded absorbent paper product, such as a paper towel for a public wash room, that provides improved absorbency to weight and to volume with respect to conventional C-fold paper products, is aesthetically pleasing and is virtually impossible to misload in a gravity feed type dispenser.

In order to achieve the above and other objects of the invention, an improved dispensable folded web product that is functionally and aesthetically superior to conventional folded web products includes, according to a first aspect of the invention, a first, central panel having a first fold line at a first end and a second fold line at a second end that is opposite from the first end; a second panel, the second panel having a first end that is joined with the first panel at the first fold line, and a second end having a third fold line defined thereat; a third panel, the third panel having a first end that is joined with the first panel at the second fold line and a second end having a fourth fold line defined thereat; a fourth panel, the fourth panel being joined to the second panel at the third fold line, the fourth panel being folder with respect to the second panel at the third fold line so that the fourth panel is positioned substantially between the first panel and the second panel; and a fifth panel, the fifth panel being joined the third panel at the fourth fold line, the fifth panel being fold with respect to the third panel at the fourth fold line so that the fifth panel is positioned substantially between the third panel and the first panel, whereby the folded web product is constructed so as to optimize weight to space considerations, to keep exposed edges out of view, and to ensure double ply strength at intended gripping locations.

An improved dispensable folded absorbent paper product that is functionally and aesthetically superior to a conventional absorbent folded paper product includes, according to a second aspect of the invention, a first, central panel; a second panel unitary with the first panel and folded over a first side of the first panel; a third panel, unitary with the first panel, and folded over a second side of the first panel; a fourth panel, unitary with the second panel, and folded so as to be positioned between the first and second panels; and a fifth panel, unitary with the third panel, and folded so as to be positioned between the first and third panels, whereby the folded absorbent paper product is constructed so as to optimize weight to space considerations, to keep exposed edges out of view, and to ensure double ply strength at intended gripping locations.

According to a third aspect of the invention, a method of dispensing a folded absorbent paper product includes steps of (a) loading an improved folded absorbent paper product into a dispenser, the improved absorbent paper product including a first, central panel; a second panel, unitary with the first panel and folded over a first side of the first panel; a third panel, unitary with the first panel, and folded over a second side of the first panel; a fourth panel, unitary with the second panel, and folded so as to be positioned between the first and second panels; and a fifth panel, unitary with the third panel, and folded so as to be positioned between the first and third panels; and (b) removing the paper product from an opening of the dispenser by grasping the paper product at the second and fourth panels.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 3:
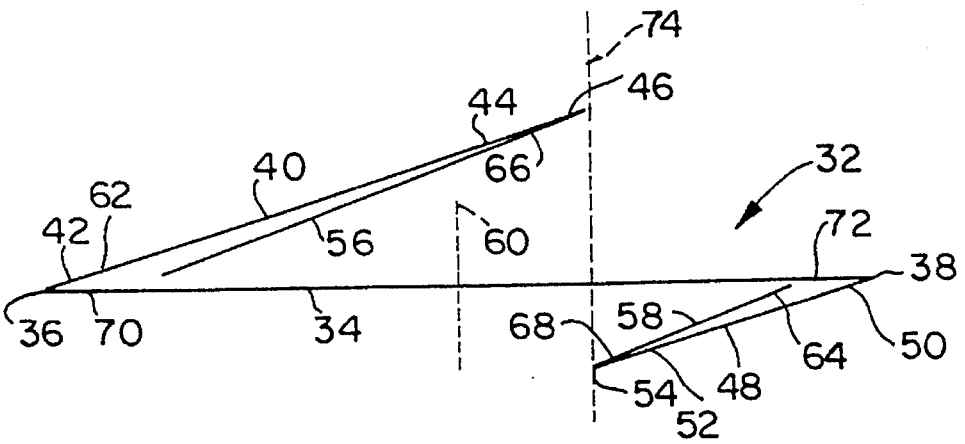
FIG. 3 is a diagrammatical cross sectional depiction of an improved dispensable folded web product that is constructed according to a preferred embodiment of the invention.

Referring now to the drawings, wherein like reference numerals designate corresponding structure throughout the views, and referring in particular to FIG. 3, an improved dispensable folded web product 32 that is functionally and aesthetically superior to conventional folded web products includes, according to a preferred embodiment of the invention, a first, central panel 34 that has a first fold line 36 at a first end 70 and a second fold line 38 at a second end 72 that is opposite from the first end 70. Web product 32, which is preferably embodied as an absorbent paper product such as a paper towel, further includes a second panel 40 having a first end 42 that is joined with first panel 34 at first fold line 36 and a second end 44 having a third fold line 46 defined thereat. A third panel 48 having a first end 50 that is joined with first panel 34 at second fold line 38 further includes a second end 52 having a fourth fold line 54 defined thereat. Dispensable folded web product 32 also includes a fourth panel 56 that is joined to second panel 40 at third fold line 46. Fourth panel 56 is folded with respect to the second panel 40 at the third fold line 46 so that fourth panel 56 is positioned substantially between the first panel 34 and the second panel 40. Similarly, improved web product 32 includes a fifth panel 58 that is joined to the third panel 48 at fourth fold line 54. Fifth panel 58 is folded with respect to third panel 48 at fourth fold line 54 so that the fifth panel 58 will be positioned substantially between the third panel 48 and the first panel 34 when folded as shown in FIGS. 3, 5 and 6.

A first edge 62 of the folded web product 32 is defined on an end of fourth panel 56 that is opposite from the third fold line 46. Similarly, folded web product 32 includes a second edge 64 that is on fifth panel 58 and is positioned oppositely from line 54. Since the fourth and fifth panels 56, 58 are folded so as to be between the second and third panels 40, 48, respectively, and first panel 34, the first and second edges 62, 64 will not be readily visible to an observer, as they are in a C-fold type paper towel. This creates an aesthetic effect that will improve the qualitative impression of the product to a consumer.

Figure 4:
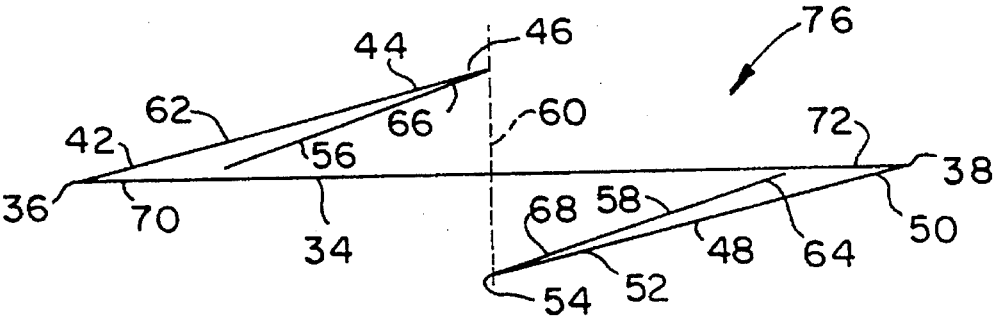
FIG. 4 is a diagrammatical cross sectional depiction of an improved dispensable folded web product that is constructed according to a second embodiment of the invention.

In all embodiments of the invention, the combined width of the second and third panels 40, 48 are not greater than the width of the first panel 34, which will insure that the web product 32 is of uniform thickness throughout when folded flat. The width of the first panel is defined as being the distance from first fold line 36 to second fold line 38. The width of second panel 40 is defined as being the distance from first fold line 36 to third fold line 46, and the width of third panel 38 is defined as being the distance from second fold line 38 to fourth fold line 54. A mid-point 60 of the distance on first panel 34 between first fold line 36 and second fold line 38 is indicated in FIGS. 3 and 4. In the embodiment of FIGS. 3, 5 and 6, second panel 40 has a width that is greater than the width of third panel 48, which causes the third fold line 46 to be positioned on an opposite side of mid-point 60 from first full line 36. This non-symmetric embodiment is the preferred embodiment of the invention, and is especially suited for gravity feed dispensers of the type that have an offset opening at the bottom. The second embodiment of the invention, shown in FIG. 4, is identical to that depicted in FIGS. 3, 5 and 6, with the exception that second panel 40 has a width that is substantially equal to that of third panel 48. This, as may be seen in FIG. 4, causes the third and fourth fold lines 46, 54 to be positioned substantially at the mid point 60 of first panel 34 when folded flat.

Figure 1:
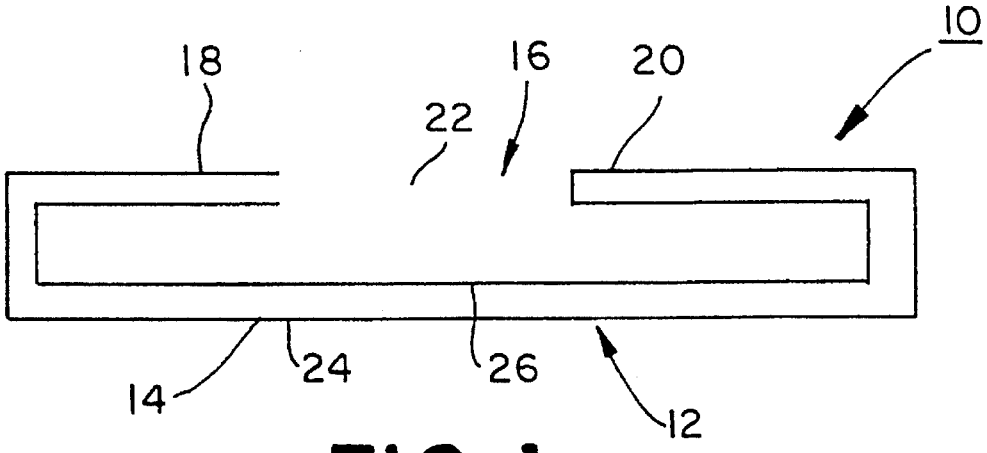
FIG. 1 PRIOR ART
FIG. 1 is a diagrammatical cross sectional depiction of a conventional C-fold type disposable paper towel.
Figure 2A:
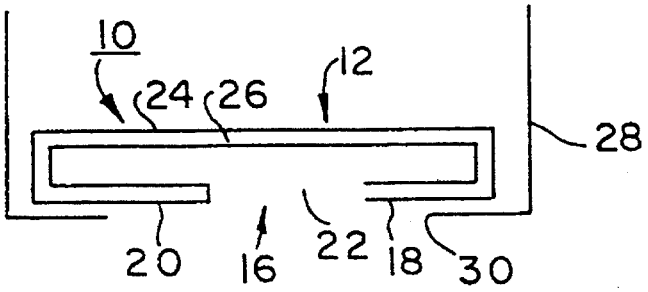
FIG. 2A PRIOR ART
FIGS. 2A and 2B are diagrammatical depictions of proper and improper, respectively, ways of loading a conventional C-fold type disposable paper towel into a gravity feed dispenser.
Figure 5:
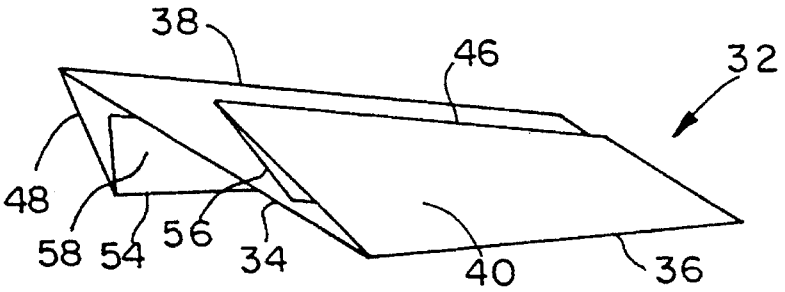
FIG. 5 is a perspective view of the improved dispensable web product depicted in FIG. 3.
Figure 6:
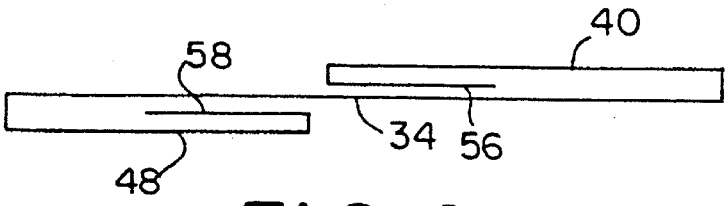
FIG. 6 is a depiction of the improve dispensable folded web product depicted in FIGS. 3 and 5, shown in a compressed folded state.
Figure 7A:
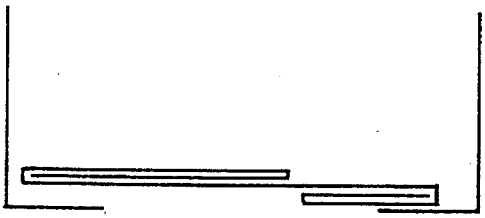
FIGS. 7A–7D are depictions of an improved disposable folded web product according to the embodiment of FIGS. 3, 5 and 6, shown loaded in different possible orientations in a gravity feed type dispenser that has a central lower opening.
Figure 7B:
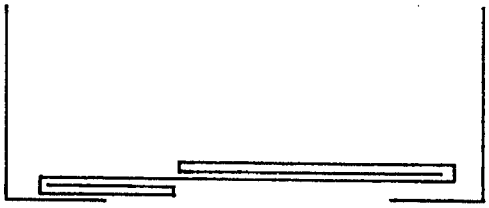
Figure 7C:
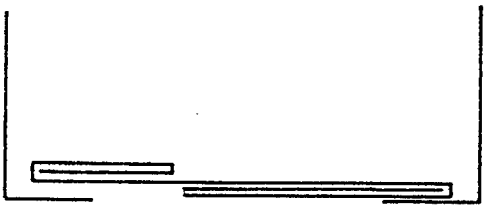
Figure 7D:
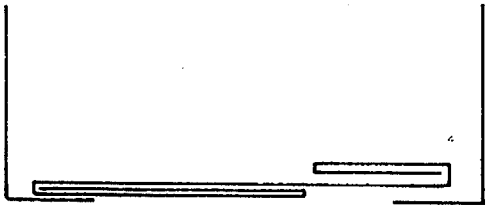
Figure 8A:
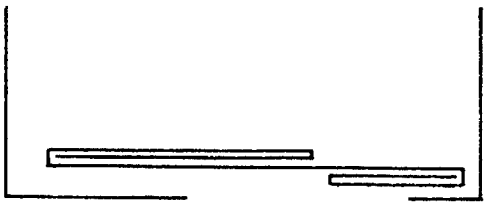
FIGS. 8A–8D are depictions similar to that provided in FIGS. 7A–7D, but with a dispenser having an offset lower opening.
Figure 8B:
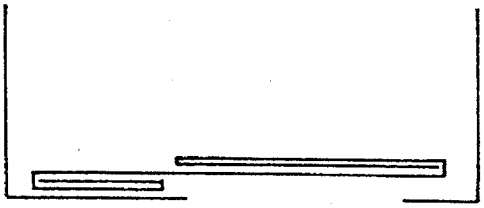
Figure 8C:
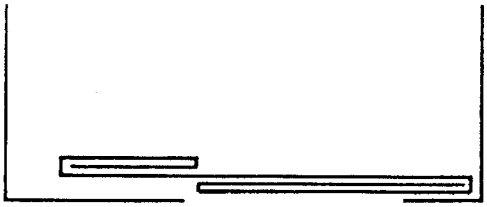
Figure 8D:
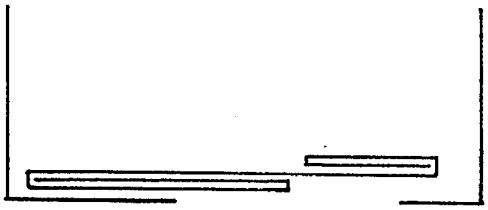

FIGS. 7A–7D depict an improved dispensable folded web product according to the embodiments of FIGS. 3, 5 and 6 being dispensed from a gravity feed type paper towel dispenser of the type that has a centered access opening at its bottom. FIGS. 7A–7D depict, respectively, the four possible orientations of the web product 32 in the dispenser 32. The orientations shown in FIGS. 7C and 7D are slightly superior in performance, but web product 32 can be effectively dispensed in any of the four orientations. This contrasts starkly with the dispensing problems with which the C-fold type paper towel is afflicted, as is discussed above in reference to FIG. 2A and 2B.

Figure 2B:
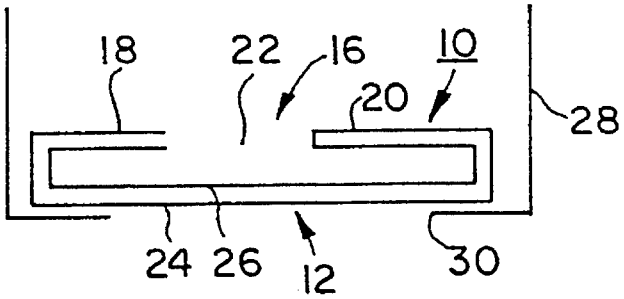
FIG. 2B PRIOR ART

FIGS. 8A–8D depict web product 32 being dispensed from a gravity feed-type paper towel dispenser of the type that has a slightly offset opening at the bottom. Again, FIGS. 8A–8D depict, respectively, the four possible orientations of the web product 32 in the dispenser. The orientation shown in FIG. 8A has been found to achieve good performance. The orientation shown in FIG. 8B will achieve poorer performance, but performance that will exceed that of the improper loading position of the C-fold type towel that is shown in FIG. 2B. The orientation shown in FIG. 8C will achieve exceptional dispensing performance. The orientation shown in FIG. 8D will achieve excellent dispensing performance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A dispensable folded unitary web product, comprising:

a first, central panel having a first fold line at a first end and a second fold line at a second end that is opposite from said first end, said first panel having a width that is defined as being a distance from said first fold line to said second fold line, said first panel having first and second opposing surfaces;

a second panel, said second panel having a first end that is joined with said first panel at said first fold line, and a second end having a third fold line defined thereat said second panel having a width that is defined as being a distance from said first fold line to said third fold line, said second panel is folded to overlap said first surface of the first panel;

a third panel, said third panel having a first end that is joined with said first panel at said second fold line and a second end having a fourth fold line defined thereat said third panel having a width that is defined as being a distance from said second fold line to said fourth fold line, said third panel is folded to overlap said second surface of the first panel;

a fourth panel, said fourth panel being joined to said second panel at said third fold line, said fourth panel being folded with respect to said second panel at said third fold line so that said fourth panel is positioned substantially between said first panel and said second panel; and a fifth panel, said fifth panel being joined to said third panel at said fourth fold line, said fifth panel being folded with respect to said third panel at said fourth fold line so that said fifth panel is positioned substantially between said third panel and said first panel, and the combined widths of said second and third panels are not greater than the width of said first panel, such that the second and third panels do not overlap, and the folded web product is constructed so as to optimize weight to space considerations, to keep exposed edges out of view, and to ensure double ply strength at intended gripping locations.

2. A web product according to claim 1, wherein said web product comprises a continuous web having a first edge and a second opposite edge, said first edge being on said fourth panel opposite to said third fold line, said second edge being on said fifth panel opposite to said fourth fold line.

3. A web product according to claim 1, wherein said folded web product is an absorbent paper product.

4. A web product according to claim 1, wherein the width of the second panel is greater than the width of the third panel, such that the folded web product is asymmetrical.

5. A web product according to claim 1, wherein the width of the second panel is substantially the same as the width of the third panel, such that the folded web product is asymmetrical.

6. A web product according to claim 1, wherein said second panel has a width that is defined as being a distance from said first fold line to said third fold line and said fourth panel has a width that is defined as being a distance from said third fold line to a first edge said web, and said width of said fourth panel is less than said width of said second panel.

7. A web product according to claim 1, wherein said third panel has a width that is defined as being a distance from said second fold line to said fourth fold line and said fifth panel has a width that is defined as being a distance from said fourth fold line to a second edge said web, and said width of said fifth panel is less than said width of said third panel.

8. A dispensable folded absorbent paper product comprising:

a first, central panel a second panel, unitary with said first panel and folded over a first side of said first panel;

a third panel, unitary with aid first panel, and folded over a second side of said first panel, said third panel not overlapping said second panel when said paper product lies flat, such that the product is a constant thickness when flattened;

a fourth panel, unitary with said second panel, and folded so as to be positioned between said first and second panels; and a fifth panel, unitary with said third panel, and folded so as to be positioned between said first and third panels, such that the folded absorbent paper product is constructed so as to optimize weight to space considerations, to keep exposed edges out of view, and to ensure double ply strength at intended gripping locations.

9. A paper product according to claim 8, wherein said second panel has a width that is greater than a width of said third panel.

* * * * *